United States Patent [19]

Bruffey

[11] Patent Number: 4,596,341

[45] Date of Patent: Jun. 24, 1986

[54] TOY DRINKING CUP

[75] Inventor: Robert D. Bruffey, Lilburn, Ga.

[73] Assignee: The Coca-Cola Company, Atlanta, Ga.

[21] Appl. No.: 777,265

[22] Filed: Sep. 18, 1985

[51] Int. Cl.[4] ..... B65D 25/40

[52] U.S. Cl. ..... 220/90.4; 220/90.2; 222/547; 222/570

[58] Field of Search ..... 220/90.2, 90.4, 90.6, 220/360, 361, 367; 222/547, 566, 570; 229/1.58

[56] References Cited

U.S. PATENT DOCUMENTS 2,608,841 9/1952 Rice ..... 220/90.6 X
3,739,938 6/1973 Paz ..... 220/90.4
3,773,243 11/1973 Greene ..... 220/90.2 X
4,219,135 8/1980 Ufferfilge ..... 222/570 X
4,241,855 12/1980 Yoshioka ..... 222/547 X

*Primary Examiner*—Steven M. Pollard
*Attorney, Agent, or Firm*—Birch, Stewart, Kolasch & Birch

[57] ABSTRACT

A toy drinking cup which simulates the appearance of a drinking container used by astronauts for consuming pre-mix carbonated beverages in outer space. The cup includes a cup body, a cap assembly, a drinking spout extending from the cap assembly, a dip tube, a vent and a lever for opening and closing the vent. When the lever is depressed, the beverage in the cup may be sucked up through the dip tube and drinking spout by the consumer.

11 Claims, 4 Drawing Figures

TOY DRINKING CUP

BACKGROUND OF THE INVENTION

The present invention relates to a toy drinking cup which simulates the appearance of a drinking container for use in the microgravity conditions of outer space, so children can emulate the astronauts drinking the beverages.

The drinking container being simulated by the structure of the present invention is described in co-pending Application Ser. No. 724,155, filed Apr. 17, 1985, assigned to the same assignee as the present invention.

As described in the above-referenced co-pending patent application, a special container construction is required to drink a pre-mix carbonated beverage in the microgravity conditions of outer space. While such a complex structure is not required on earth to drink a beverage of this type, a simulated structure could have great appeal as a toy for children so that they can emulate their astronaut heroes while drinking these beverages.

SUMMARY OF THE INVENTION

Accordingly, it is a primary object of the present invention to provide a drinking cup structure which simulates the actual appearance of a more complex structure suitable for drinking premix carbonated beverages in the microgravity conditions of outer space.

It is a further object of the present invention to provide such a simulated structure which is simple and low-cost, and includes only four molded parts.

It is another object of the present invention to provide such a simulated drinking cup structure which is easy to clean and assemble.

The objects of the present invention are fulfilled by providing a drinking cup for a beverage comprising: a cup body defining a reservoir for said beverage having an open end; a cap assembly removably secured over the open end; a drinking spout extending from the cap assembly; a dip tube in fluid communication with the drinking spout and extending into the reservoir of the cup body; a vent in the cap assembly in fluid communication with the drinking spout and dip tube; and a lever mounted in the cap for opening and closing the vent; whereby the beverage may be sucked through the drinking spout and dip tube by a consumer when the vent is closed by the lever.

In a preferred embodiment, the lever is a leaf spring molded from plastic which is secured at a base end to the cap assembly and is normally biased to a position spaced from the vent. The lever has an actuation end opposite to the base end for depressing the lever to close the vent. The base end of the lever is snap-fit to the cap, and includes a protrusion on the underside thereof for engaging and closing the vent.

The entire cap assembly may be snap-fit onto a rim surrounding the open end of the cup body to facilitate filling and cleaning of the cup. The cap assembly also has a pressure relief vent therein for venting the cup to the atmosphere.

Preferably, the entire drinking cup is fabricated from plastic with a high melting point so that it may be cleaned in a dishwasher. For ease of cleaning, the respective parts are snap-fit together so that they may be easily separated for cleaning. For example, the dip tube structure extending into the container body is readily removable from the cap assembly; the lever is readily removable from the cap assembly; and the cap assembly is readily removable from the cup body.

BRIEF DESCRIPTION OF THE DRAWINGS

The objects of the present invention and the attendant advantages thereof will become more readily apparent by reference to the acompanying drawings wherein.

DETAILED DESCRIPTION OF PREFERRED EMBODIMENTS

Figure 1:
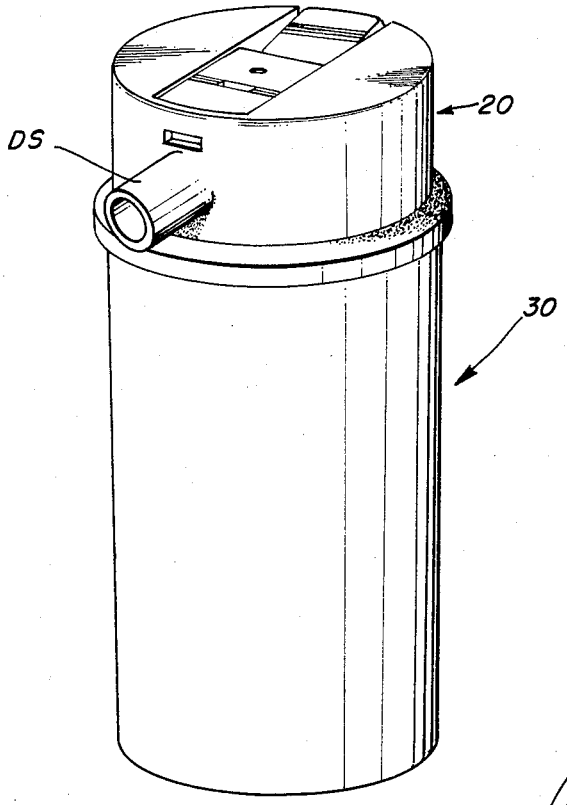
FIG. 1 is a perspective view of the drinking cup according to the present invention.
Figure 2:
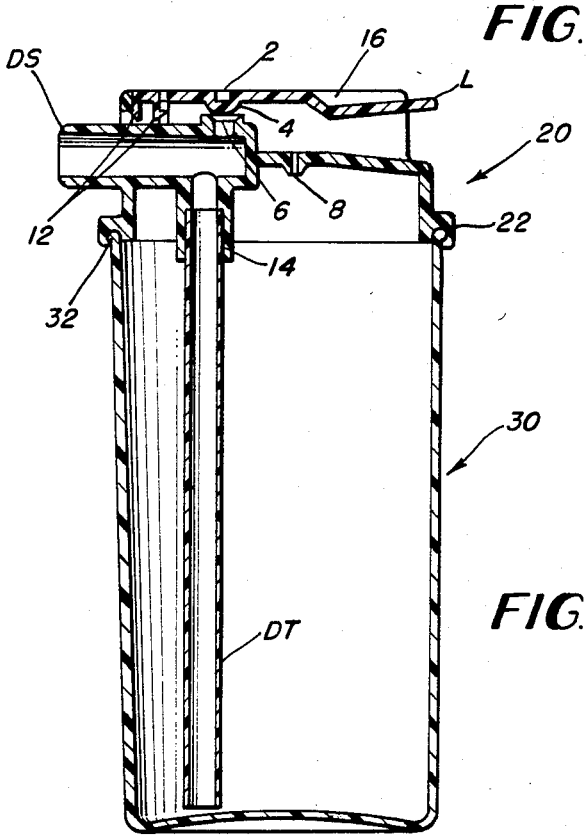
FIG. 2 is a cross-sectional view in side-elevation of an assembled drinking cup according to the present invention.
Figure 3:
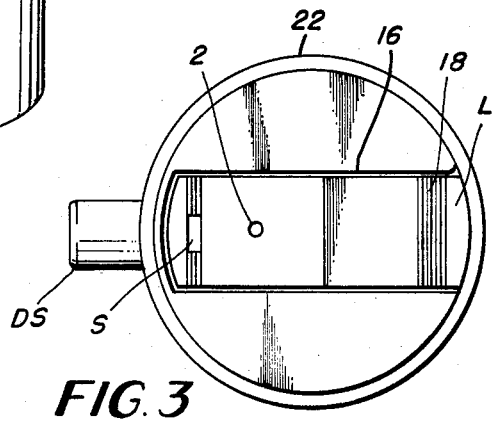
FIG. 3 is a top plan view of the cap assembly of the drinking cup of the present invention.
Figure 4:
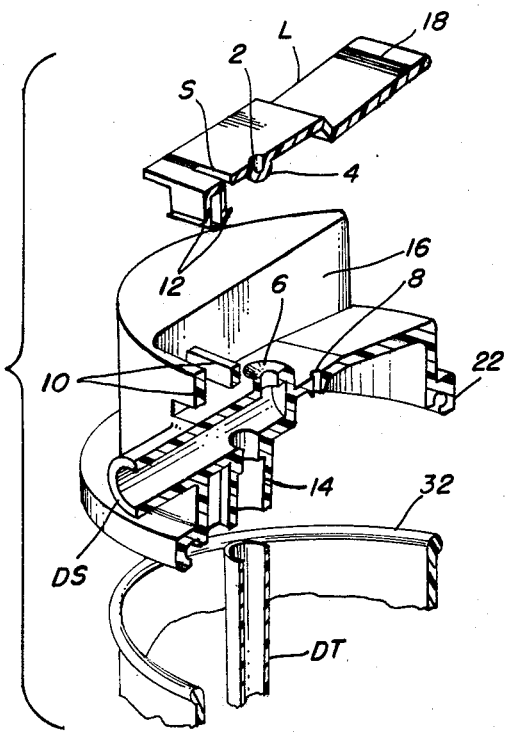
FIG. 4 is an exploded view in cross-section, illustrating how the respective components of the drinking cup of the present invention snap-fit together.

Referring collectively to the respective figures of the drawings, there is illustrated a drinking cup, including a cup body 30 and a cap assembly 20 which is snap-fit to the open end of cup body 30 by means of a peripheral bead 32 on the cup body and a groove 22 on the underside of the cap assembly 20. Extending from a sidewall of the cup assembly 20 is a drinking spout DS through which beverage in the cup may be sucked by a consumer up through a dip tube DT and the drinking spout DS.

However, drinking spout DS and dip tube DT are normally vented to the atmosphere through a vent 6 in the top wall of spout DS.

Accordingly, when so vented the beverage within the cup cannot be easily sucked out through the spout DS. Therefore, a lever L is provided having a protrusion 4 on the underside thereof formed by a molded depression 2. The protrusion 4 is aligned with the vent 6 for operative engagement therewith. One end of lever L is snap-fit to the cap assembly 20 under transverse rib members 10 by means of hook-shaped extensions 12 on the underside of the lever L. The opposite end of lever L is provided on its upper surface with ridges 18 to provide an anti-slip surface engageable by a consumer's finger. Accordingly, when the consumer or operator depresses lever L by engaging the anti-slip ridges 18 on the upper surface thereof, protrusion 4 closes vent 6 and provides a closed path through which the beverage may be sucked up through dip tube DT and out of spout DS into the mouth of a consumer.

The lever L is a flexible leaf spring type of structure and is normally biased to space protrusion 4 from vent 6 by the normal resilience and flexibility of the material from which it is fabricated. To increase this resilience or flexibility, a slot S may be provided.

Preferably, the cap assembly is an integrally molded part which includes a dome-shaped housing; a cylindrical drinking spout extending from one sidewall thereof to the interior of the dome-shaped housing; and a tubular socket communicating at one end with the cylindrical drinking spout, and at the other end with an upper end of the dip tube DT. The dip tube DT is press-fit into this socket 14 so it can be readily removed for cleaning.

An additional pressure relief vent 8 is provided extending through the top wall of the dome-shaped housing of the cap assembly to vent the interior of the cup to the atmosphere. This pressure relief vent will relieve internal pressure in the cup in the event that a child should shake up the contents thereof or drop the cup onto the floor. The venting through vent 8 will minimize the chance of the cap assembly becoming detached from the cup body 30.

The entire drinking cup assembly of the present invention is preferably fabricated from a high melting point and high-strength plastic.

It should be understood that the drinking cup of the present invention may be modified as would occur to one of ordinary skill in the art without departing from the spirit and scope of the present invention.

What is claimed is:

1. A drinking cup for a beverage comprising:

(a) a cup body defining a reservoir for containing said beverage having an open end;

(b) a cap assembly removably secured over said open end;

(c) a drinking spout extending from said cap assembly;

(d) a dip tube in fluid communication with said drinking spout and extending into the reservoir of said cup body;

(e) a vent in said cap assembly in fluid communication with said drinking spout and dip tube; and (f) a lever mounted in said cap for opening and closing said vent;

whereby said beverage may be sucked through said dip tube and drinking spout by a consumer when said vent is closed by said lever.

2. The drinking cup of claim 1, wherein said lever is a leaf spring secured to the cap assembly at a base end and normally biased to a position spaced from said vent, said lever having an actuation end opposite said base end for depressing said lever to close said vent.

3. The drinking cup of claim 2 wherein said lever has a protrusion for engaging and closing said vent.

4. The drinking cup of claim 2, wherein said lever has a slot therein for increasing the flexibility thereof.

5. The drinking cup of claim 2, wherein said lever is snap-fit to said cap at said pivot end.

6. The drinking cup of claim 5, wherein said lever has a protrusion for engaging and closing said vent.

7. The drinking cup of claim 6, wherein said lever has a slot therein for increasing the flexibility thereof.

8. The drinking cup of claim 5, wherein said lever has a slot therein for increasing the flexibility thereof.

9. The drinking cup of claim 1, wherein the open end of said cup body has a peripheral bead and said cap assembly has a means for snap-fitting the cap assembly to said bead.

10. The drinking cup of claim 1, wherein said cap assembly is an integrally molded part including said drinking spout extending from a sidewall thereof, a socket for supporting said dip tube, a recess in a top surface for accommodating the movement of said lever and an aperture in the bottom of said recess defining said vent.

11. The drinking cup of claim 1, further including a pressure relief vent extending through said cap assembly to vent said reservoir to the atmosphere.

* * * * *